US008291623B2

(12) United States Patent
Shirland

(10) Patent No.: US 8,291,623 B2
(45) Date of Patent: Oct. 23, 2012

(54) FRONT MOUNTED TRACTOR SNOW BLOWER

(76) Inventor: Bruce V. Shirland, Old Town, ME (US)

( * ) Notice: Subject to any disclaimer, the term of this patent is extended or adjusted under 35 U.S.C. 154(b) by 183 days.

(21) Appl. No.: 12/755,798

(22) Filed: Apr. 7, 2010

(65) Prior Publication Data

US 2011/0247244 A1 Oct. 13, 2011

(51) Int. Cl.
*E01H 5/09* (2006.01)

(52) U.S. Cl. ..... 37/244; 37/231

(58) Field of Classification Search ..... 37/235, 37/242, 244, 248, 249, 250, 263; 172/817
See application file for complete search history.

(56) References Cited

U.S. PATENT DOCUMENTS

| | | | | | |
|---|---|---|---|---|---|
| 1,586,209 | A | * | 5/1926 | Mayer | 37/248 |
| 1,822,827 | A | * | 9/1931 | Shappell | 37/248 |
| 1,923,444 | A | * | 8/1933 | La Clair | 37/248 |
| 2,152,860 | A | * | 4/1939 | Behrens et al. | 37/248 |
| 2,588,039 | A | * | 3/1952 | Pepi | 37/228 |
| 2,867,921 | A | * | 1/1959 | Brown | 37/231 |
| 3,320,688 | A | * | 5/1967 | Haban et al. | 37/242 |
| 3,691,860 | A | | 9/1972 | Danuser | |
| 3,731,757 | A | * | 5/1973 | Bozsik | 180/6.26 |
| 3,808,715 | A | * | 5/1974 | Haban | 37/260 |
| 4,011,668 | A | * | 3/1977 | Gunderson | 37/260 |
| 4,367,603 | A | * | 1/1983 | Schlapman | 37/251 |
| 4,477,988 | A | * | 10/1984 | Vohl | 37/250 |
| 4,549,365 | A | * | 10/1985 | Johnson | 37/251 |
| 4,825,570 | A | | 5/1989 | Schmid et al. | |
| 5,101,911 | A | * | 4/1992 | Lee et al. | 172/48 |
| 5,346,018 | A | | 9/1994 | Koster | |
| 5,479,730 | A | * | 1/1996 | Gogan | 37/231 |
| 5,653,509 | A | * | 8/1997 | Bieri, Jr. | 299/39.3 |
| 5,685,689 | A | | 11/1997 | Schneider et al. | |
| 6,178,668 | B1 | | 1/2001 | Gustafson et al. | |
| 6,199,306 | B1 | * | 3/2001 | Kauppila et al. | 37/249 |
| 6,499,237 | B2 | | 12/2002 | Johnson | |
| 6,508,018 | B1 | | 1/2003 | O'Brien | |
| 6,931,771 | B1 | * | 8/2005 | Liebl | 37/260 |
| 7,329,082 | B2 | | 2/2008 | Warren | |
| 7,343,994 | B2 | * | 3/2008 | Wakitani et al. | 180/65.265 |
| 7,712,232 | B2 | * | 5/2010 | Majkrzak | 37/252 |
| 2002/0095824 | A1 | * | 7/2002 | Johnson | 37/241 |
| 2005/0097788 | A1 | * | 5/2005 | Wakitani et al. | 37/348 |
| 2006/0236565 | A1 | * | 10/2006 | Gautreau et al. | 37/260 |
| 2007/0062076 | A1 | | 3/2007 | Majkrzak | |
| 2009/0205226 | A1 | * | 8/2009 | Olmr et al. | 37/257 |

OTHER PUBLICATIONS

Erskine Attachments Inc., Loader Mounted Hydraulic Snow Blower/ Power Unit, http://www.erskineattachments.com/snow_attachments_catalog/?view=loader_mounted_hydraulic_snowblower_powerunit&p=4, 4 pages, copyright 2007-2008, Erskine Attachments and Northern Heart Media.

Quick Attach Skid Steer Attachments, Universal Quick Attach Plates for Skidsteer/Skid Steer/Loader/ Compact Trailer, http://www.buyattachmentsdirect.com/skidsteerattachments/quick-attach-plates, 2 pages, copyright 2008, Attachments Direct, Inc. and Northern Heart Media.

* cited by examiner

*Primary Examiner* — Jamie L McGowan
(74) *Attorney, Agent, or Firm* — Dennis R. Haszko

(57) ABSTRACT

An independently powered tractor snow blower that is capable of being front mounted to the tractor and has an independent power source. The snow blower is capable of being easily connected and removed to the front of the tractor, and provides compact, stable, and versatile operation when in use.

18 Claims, 4 Drawing Sheets

FRONT MOUNTED TRACTOR SNOW BLOWER

FIELD OF THE INVENTION

The present invention relates generally to snow removal systems. More particularly, the present invention relates to independently driven front-mounted tractor snow removal systems.

BACKGROUND OF THE INVENTION

Snow blowers are machines that facilitate rapid snow removal. They can be essential for removing snow from driveways, sidewalks, roads, paths and the like. Unlike plows, instead of pushing the snow, snow blowers throw the snow a substantial distance away from the area where it is not wanted, minimizing the accumulation of snow banks. Typically, these snow blowers operate by using auger style blades to transmit snow into fan style blades, which throws the snow through a chute away from the snow blower.

A variety of snow blower devices exist. In some cases, these devices may be guided by hand and may be sized similar to a walk-behind lawn mower. In other cases, larger versions of these snow blowers are mounted to tractors at the rear, and utilize a power take off (PTO) shaft that takes power from the engine to drive the snow blower. In yet other cases, the snow blowers may be connected to the front of the tractor and powered by a hydraulic system. In other cases, snow blowers may be mounted to the front of non-tractor vehicles, and powered utilizing a PTO shaft.

Snow blowers guided by hand are much smaller than those mounted to vehicles, and they require a great deal of time and physical exertion to clear a large area. Rear tractor-mounted snow blowers are difficult to use because they must be used when the tractor is in reverse. Further, these rear mounted units are cumbersome to attach and set up, and require the tractor engine to be operated at high revolutions per minute (RPM) to achieve effective snow removal. This increases fuel consumption and causes wear and tear on the engine. Front mounted hydraulic snow blowers are often highly expensive, pricing out all but large industrial operations. Further, front mounted hydraulic systems are very difficult to mount and set up, often taking upward of eight hours to install with specialized equipment and skills, and are subject to frequent hydraulic leaking.

Attempts have been made to effectively mount snow blowers to tractors. One such attempt is found in United States Patent Pub. No. 2007/0062076 filed by Majkrzak on Sep. 19, 2005, and published on Mar. 22, 2007 for a "Concentric Axis Snow Blower Attachment." Majkrzak discloses a snow blower attachment that includes a concentric axis fan and auger. The fan and auger are independently powered by respective hydraulic motors.

Another attempt is found in U.S. Pat. No. 6,178,668, issued to Gustafson et al. on Jan. 30, 2001 for an "Apparatus and Method for Connecting an Implement to a Traction Vehicle." The Gustafson et al. device discloses an implement mounted at a first end of a vehicle and an engine mounted at a second end of the vehicle. A support structure extends between the two ends and supports a drive shaft assembly Yet another attempt is found in U.S. Pat. No. 6,499,237 issued to Johnson on Dec. 31, 2002 for a "Snow Blower." The Johnson device discloses a snow blower that augers snow scraped from a path to a fan. The fan is co-axial with the auger at one end of an auger housing. A fan shaft extends through an auger tube. The fan shaft is supported on one end by a fan housing bearing in the auger tube. The auger is supported at one end by a drive housing bearing attached to the housing, and at the other end by a bearing on the fan shaft.

None of these known attempts at producing an effective snow blower device have overcome the above-noted disadvantages. It is therefore desirable to provide a front mounted tractor snow blower that is affordable, easy to set up, and easy to use.

SUMMARY OF THE INVENTION

It is an object of the present invention to obviate or mitigate at least one disadvantage of previous tractor mounted snow blowers.

In a first aspect, the present invention provides an independently powered snow blower for front mounting on a tractor, the blower including: a body having a front, rear, top, and bottom portions, the body defining a snow capturing cavity at the front portion; a plurality of internal components for snow movement being located within the body; a motor mount plate positioned along the top portion of the body; a power source mounted to the motor mount plate, the power source mechanically connected to the internal components via a drive train, the power source providing a motive power for operation of the internal components; a universal mounting plate attached to the rear portion of the body at a distance away from the body, the distance sufficient to provide space for the drive train, and the universal mounting plate constructed and arranged to facilitate quick removable connection to a connection point of a plurality of tractor lift arms; and a clutch being constructed and arranged within the drive train to selectively isolate the power source from the internal components; wherein the snow blower is operable at extreme upper and extreme lower positions of the plurality of tractor lift arms, and any position within a range of motion achievable by the plurality of tractor lift arms.

In a further aspect, the present invention provides a kit for assembly of an independently powered front mounted tractor snow blower including: a snow blower body having internal components capable of controlled movement of snow; an independent power source capable of providing motive power for operation of the internal components of the body; a motive connection mechanism capable of transferring power between the independent power source and the internal components; a mounting mechanism capable of mounting the independent power source to the snow blower body; a clutch capable of selectively isolating motive power provided by the independent power source from the internal components; a universal mounting plate capable of facilitating quick removable connection between the snow blower body and a plurality of tractor lift arms; and an attachment mechanism capable of attaching the universal mounting plate to a rear portion of the snow blower body.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached figures.

DETAILED DESCRIPTION

Generally speaking, tractor mounted snow blowers are either affordable but cumbersome to set up and use, or highly expensive, extremely cumbersome to set up, but easy to use. This problem has existed for many years, yet no solution has been presented. The present invention addresses all of these issues by providing a tractor mounted snow blower that is affordable, easy to set up, and easy to use.

The snow blower described herein is designed to be configured as an independently driven unit that may be quickly, easily, and removably connected to the front of a tractor. Such connection is enabled by an integrated quick attachment plate that forms part of the invention so as to provide quick mounting upon corresponding coupling mechanisms affixed to the tractor's arms. Such a mounting configuration provides an ease of set-up heretofore unseen in the art. This snow blower configuration also provides safe and comfortable forward-driving use. The snow blower has an independent power source to mechanically drive the snow blower without regard to the tractor's engine or power train. Moreover, the snow blower power source may be controllable from the operator's seat of the tractor to further facilitate ease of use. Configuring the snow blower in this way allows maximum ease of set up, use, safety, and affordability. Such attributes make the present invention ideal for home and light-industrial users. As such, the snow blower could be provided to the end-consumer through retail stores that sell tractors and other tractor supplies either coupled with original equipment or for after-market purposes.

Figure 1:
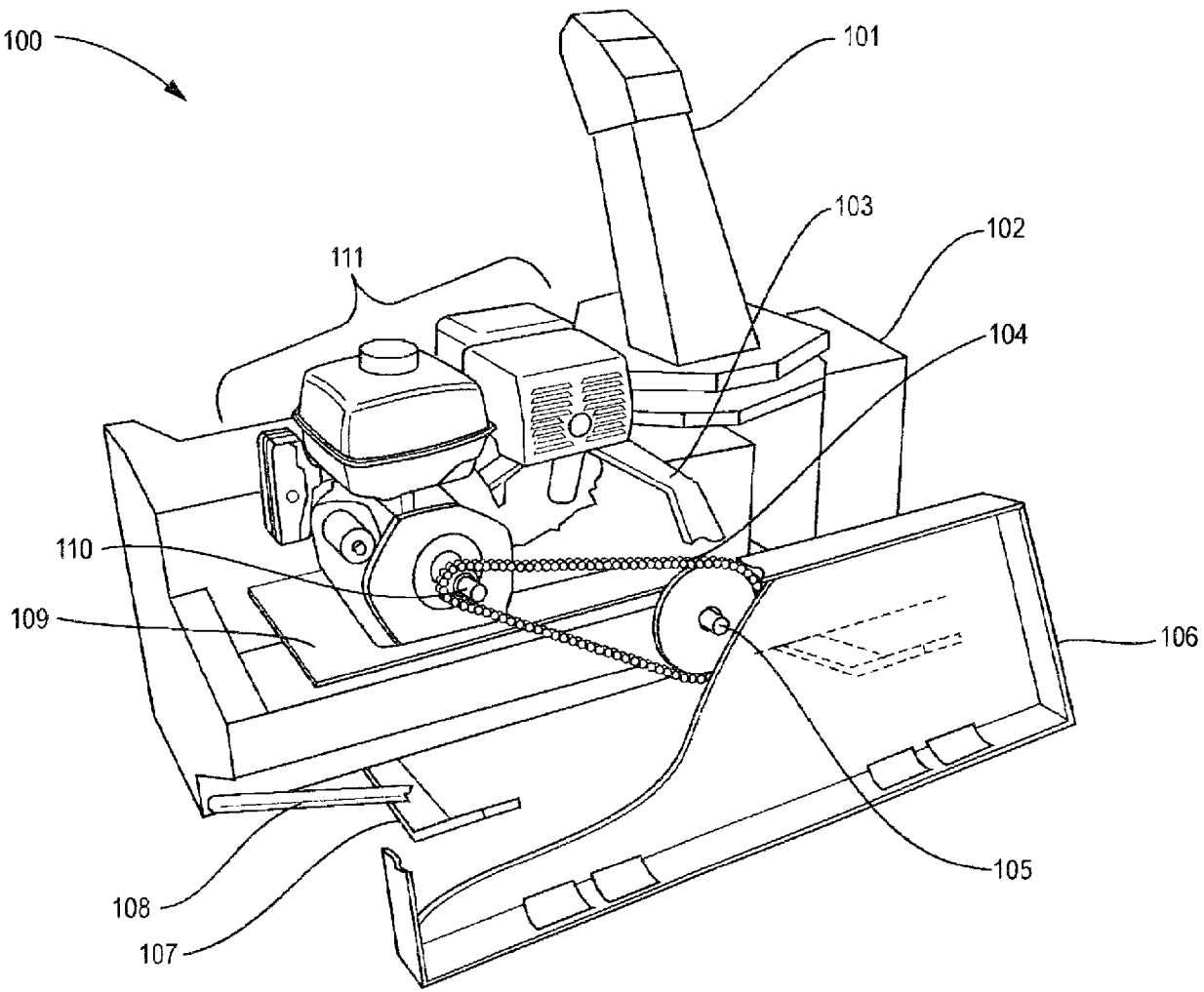
FIG. 1 is a perspective view of an independently driven snow blower attachment in accordance with the present invention shown with a partial cutaway of an integrated quick attachment plate.

Referring to FIG. 1, a front mounted tractor snow blower 100 is shown in perspective view with a partial cutaway to reveal interior drive elements. The snow blower 100 has a body 102 that forms a snow capturing cavity (hidden from view in rear of perspective) in a manner well known in the snow removal art. In addition to sides, the body 102 includes front, rear, top, and bottom portions and thereby forms the base structure for the snow blower 100 in accordance with the present invention. The front portion of the body 102 defines the snow capturing cavity as mentioned (hidden from view). The snow moving components of the body 102 may include those components typical of any known snow blower unit including internal blades (e.g., auger-type blades 402 shown in FIG. 4) and a chute 101. Typical known snow blower units can be two-stage mechanisms that include a helical auger blade and a central fan blade. As is known in the art, the auger blade slowly rotates through an internal gear box and moves snow in a first stage laterally towards the second stage fan blade which more quickly rotates also via the gear box to throw accumulated snow up and out the chute 101. Such two-stage operation and gear box mechanics is well known in the snow removal art and will therefore not be further described or shown herein. Moreover, any similar internal mechanisms including, but not limited to double auger or multiple stages beyond two-stage, are possible without straying from the intended scope of the present invention.

As mentioned, the body 102 provides the base structure for the present inventive snow blower 100. Further, the rear portion of the body 102 includes a motor mount plate 109, constructed and arranged to receive a power source 111. The power source 111 is any source of motive power and may include compact gasoline engines, propane engines, diesel engines, electric motors, or any similar self-contained motive source of power. For purposes of illustration, the power source 111 is a self-contained compact gasoline engine which itself may be pull-start or, more advantageously, electric start for operation via electrical wiring from the tractor operator's seat. Details of such electrical wiring and any related wire harness are well understood in the electrical art and are not further discussed herein. The power source 111 is securely mounted on the motor mount plate 109, and provides motive power for the operation as discussed above of the internal gearbox which in turn operates the auger and fan blades.

The power source 111 is selectively isolated from the internal gearbox via a clutch (shown as element 301 and later discussed in regard to FIGS. 3 and 4). A universal mounting plate 106 is integrated within the snow blower 100 by attachment to the rear portion of the body 102. It should be readily understood that such attachment of the plate 106 is made preferably by secure physical connection (e.g., via welds or bolts) to the body 102. Structural supports 103, 107, and 108 each form a part of this secure physical connection and also serve to distance and orient the plate 106 relative to the body 102. As discussed further herein below, the plate 106 is constructed and arranged to facilitate removable connection of the snow blower 100 with a front end of a tractor (not shown).

The specific supports 107 are located along the bottom and towards the sides of the body 102. In particular, supports 107 are configured to also function as support skids at the portions mounted in parallel with the surface of the bottom of the body 102. Advantageously, these support skids 107 provide stability. Such stability is provided both when the snow blower is not in use (i.e., detached from a tractor and stored) and when in use to assure smooth travel along the ground. Moreover, the skid supports 107 may extend from front to back along the entire bottom surface of the body 102 to further ensure smooth tracking of the snow blower 100 over non-ideal (e.g., bumpy or uneven) surfaces. During such operation, the typical float setting for a common tractor's joystick control would of course be engaged. While the supports 103 and 108 may be fabricated solely of steel or similarly durable material, the skid supports 107 may further include a surface coat of a polymer, additional plastic covering, or replaceable plastic or metal runner or shoes to improve sliding motion over the ground and enhanced overall durability.

It should be understood that the snow blower body 102 may be of any size and shape that allows a connection to the tractor via the plate 106. Sizing may of course be dictated by the intended size and model of tractor and also desired snow removal capacity. The snow blower 100 and its components may be constructed of any material sufficiently durable for the intended usage as a tractor implement. Such materials may include, but are not limited to, steel, aluminum, metallic alloys, and hard plastics. Preferably, the body 102 may be constructed of a material rigid and durable enough to support the weight and forces of the snow blower 100 in operation.

Detail of the operation of the snow blower internal components is beyond the scope of the present invention, but is integral to the use of the present invention, and is thus described herein so as to provide proper enablement to practice the present invention. As mentioned, the snow blower body 100 is structured to define a snow collection cavity. An auger (seen as element 402 in FIG. 4) is positioned lengthwise within the snow collection cavity. The auger may rotate about a horizontally aligned auger shaft. The auger may be constructed as either a single helix, or as an opposed double helix such that when the auger shaft rotates, the auger pushes snow to one side of the housing in the case of a helix, or to the center of the housing in the case of an opposed double helix. A fan is located within an opening in the snow collection cavity, and the fan may be partially enclosed in a fan housing. Such fan and fan housing may be positioned centrally in the case of an opposed double helical auger, or may be positioned on either side of the body towards which the auger directs the snow in the case of a single helix. The fan rotates about a horizontal fan shaft. Both the auger shaft and the fan shaft are mechanically driven by way of a gear box in a manner well known within the mechanical art. As already discussed, the gear box itself is driven ultimately by the power source 111. Snow is thus drawn towards the fan by the auger, whereby the fan then forces the snow into the fan housing which discharges the snow through a snow outlet port in the housing. A rotatable chute is connected to the snow outlet port, and allows directional movement of the discharged snow. The chute may be manually rotated or remotely rotated by the tractor operator via an additional electric motor and related wiring as is also known in the electrical and mechanical arts.

Detail of the configuration of tractor lift arms is beyond the scope of the present invention, but is integral to the use of the present invention and is thus described herein so as to provide proper enablement to practice the present invention. An exemplary tractor may have a chassis with a centrally positioned cab. Commonly, such tractor includes a front end mounted scoop bucket well known in the mechanical art and supported by two lift arms. The lift arms may be attached to the left and right of the cab. Typically, though not always, these tractor lift arms are hinged towards the rear portion of the vehicle to optimize weight distribution. A connection point is positioned at a forward end of each tractor lift arm. The forward end of each tractor lift arm may include pivot actuators to allow the connection points to pivot along a vertical axis. The connection point allows implements such as the aforementioned scoop bucket to be removably attached thereto. Through the use of well known universal quick attach plates such as those available from ATTACHMENTS DIRECT, INC. of Alexandria, Minn., USA, alternative implements such as a set of bale forks, or more to the point, the present invention may also be removably and interchangeably connected to the tractor lift arms. It should be understood that any similarly configured mounting plate that allows quick and easy connection between tractor lift arms, with further discussion with regard to FIG. 4 below, and the snow blower 100, may be used.

Figure 2:
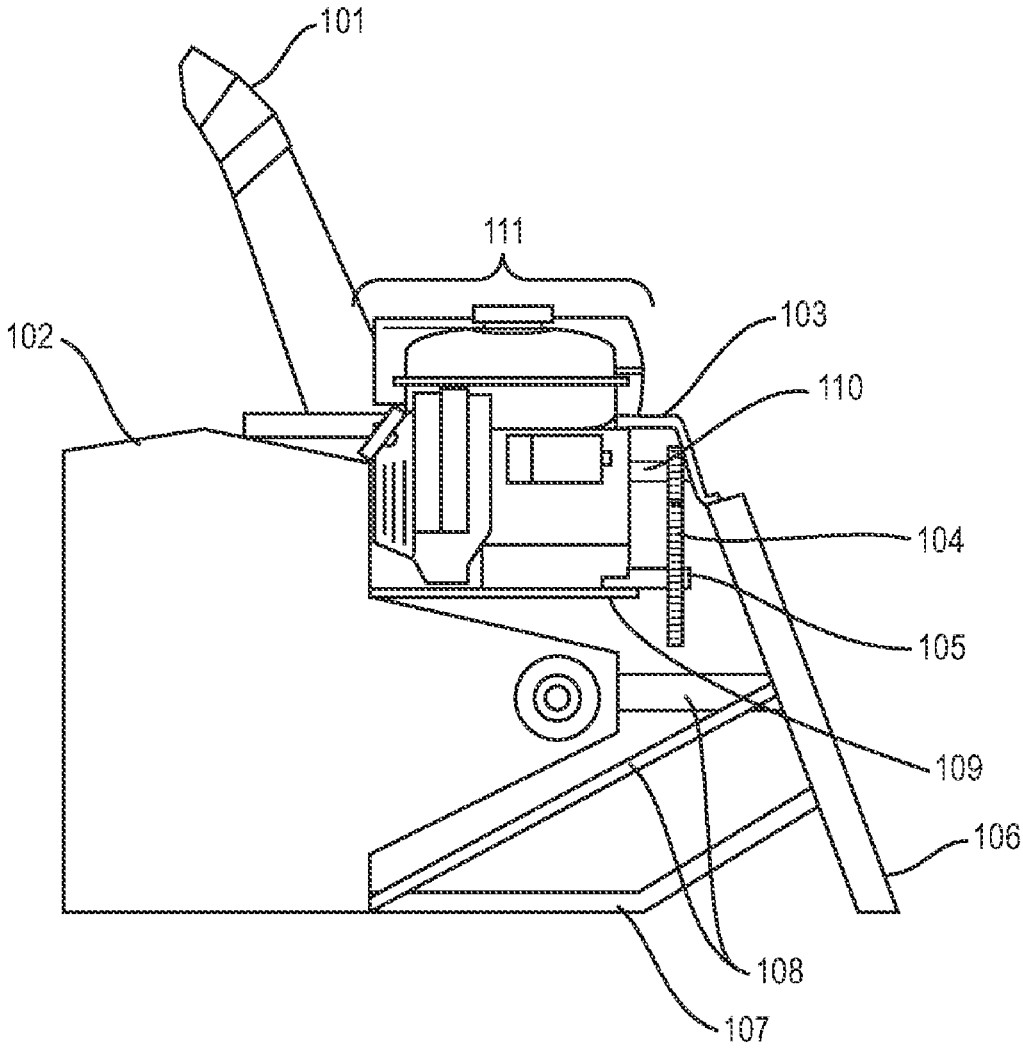
FIG. 2 is a side view of the independently driven snow blower attachment shown in FIG. 1.
Figure 3:
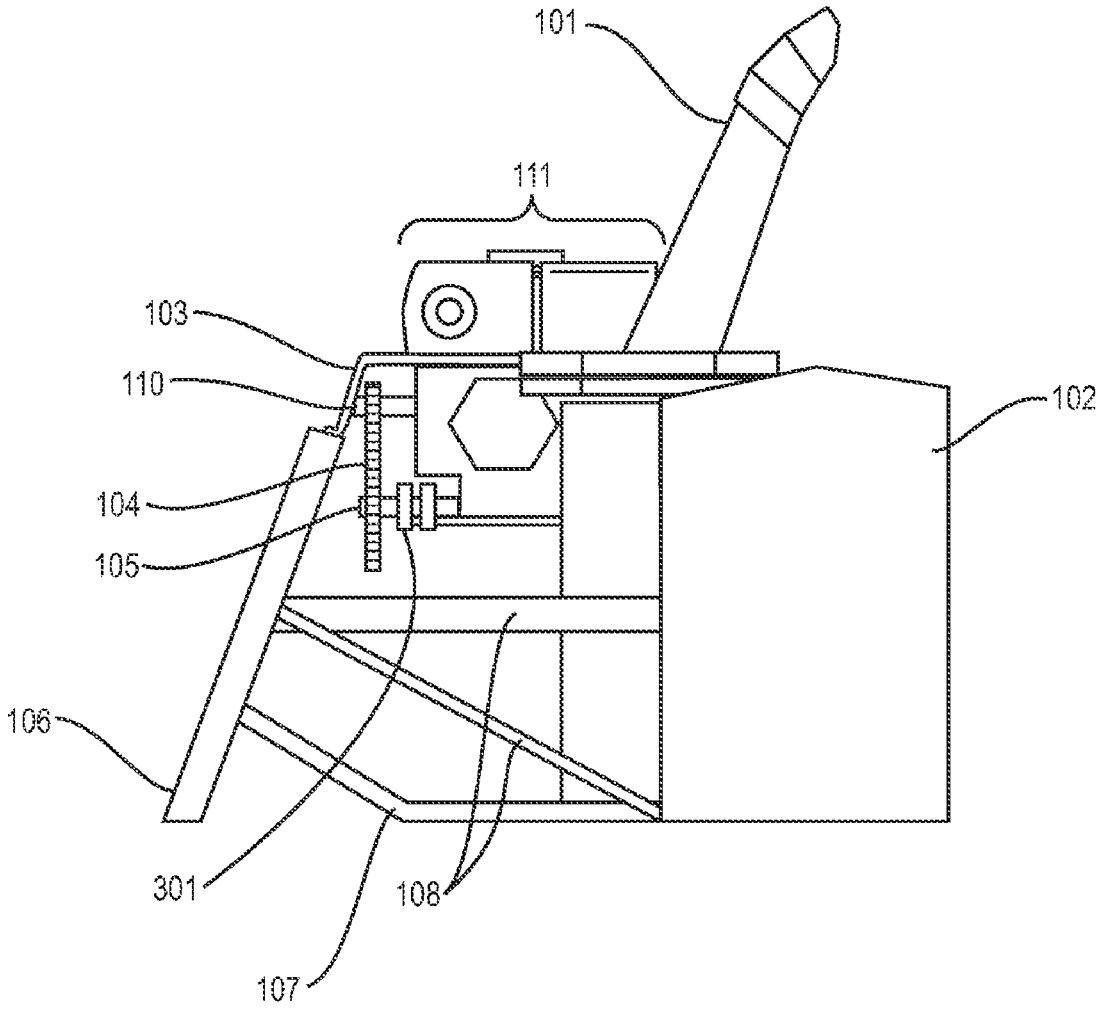
FIG. 3 is another side view opposite from that shown in FIG. 2.
Figure 4:
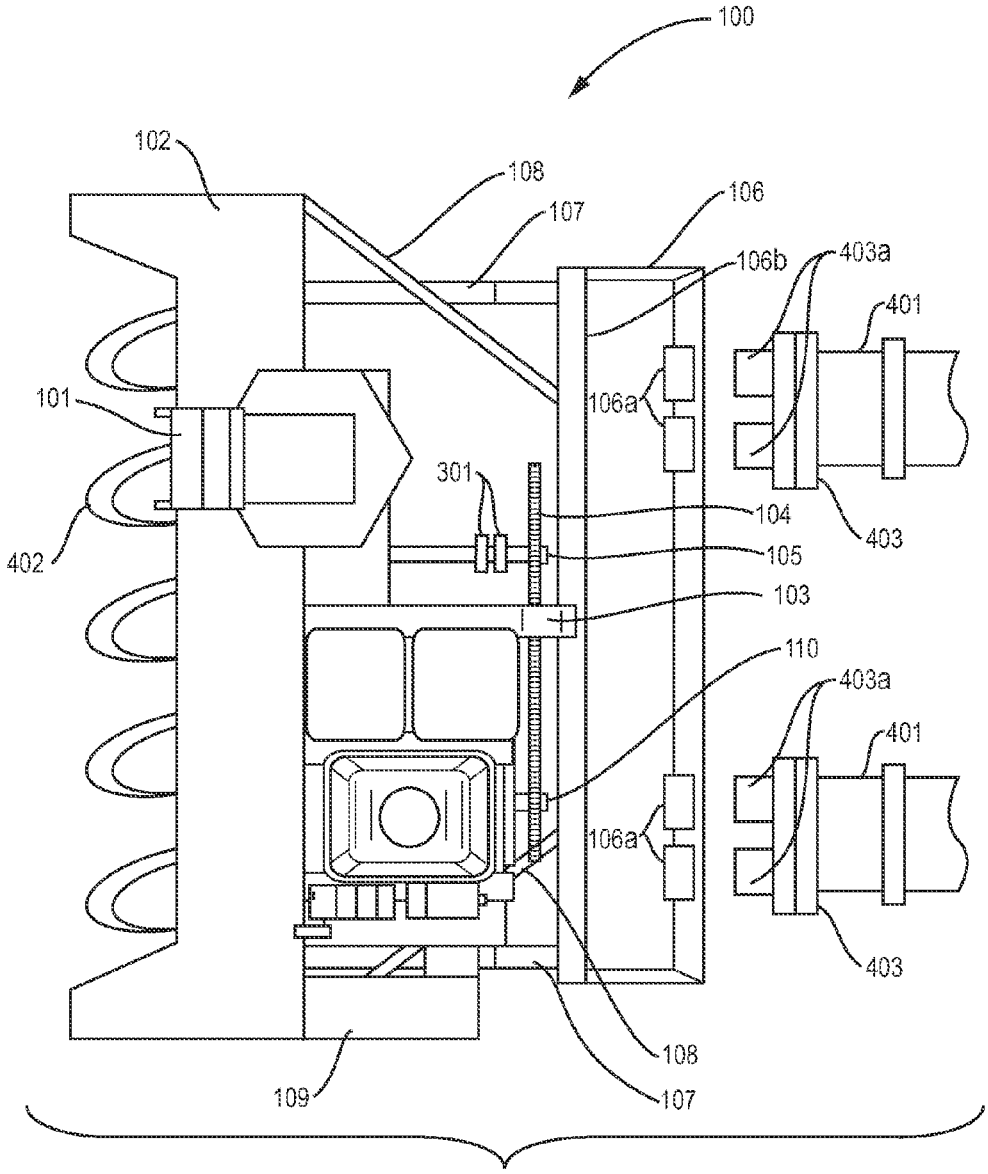
FIG. 4 is a top view of the independently driven snow blower attachment shown in FIG. 1 showing, in simplified form, the integrated quick attachment plate in conjunction with mating tractor arms for coupling with the integrated quick attachment plate.

With further regard to the side and top views of the present invention shown in FIGS. 2 through 4, the universal mounting plate 106 can be seen attached to the rear portion of the snow blower body 102. The plate 106 is affixed at an angle relative to the rear-facing plane of the back of the body 102. This enables the tractor operator maximum line of sight to the point of connection on the plate 106 while they are seated and operating the tractor. Accordingly, the orientation of the plate 106 at an angle also facilitates quick alignment the tractor arms 401 with the plate 106. This angled orientation is established by the configuration of supports 103, 107, and 108 as shown. It is intended further that the supports 103, 107, and 108 are sized so as to reduce the distance of the plate 106 from the body 102. This distance provides only sufficient space for the operation of the power source 111 and results in compactness in terms of the front to back width of the snow blower 100. This compactness advantageously keeps the weight of the snow blower 100 closer to the tractor arms 401 which aids in the overall weight distribution along the length of a tractor having the invention attached. This adds to the overall stability during use.

As shown, the power source 111 is employed to mechanically drive the snow blower 100 via a drive train that includes at least the power source 111, a power providing crankshaft 110, a belt 104, a power receiving shaft 105, and a power transferring clutch 301 transmitting motive power to a receiving gearbox (not shown, but described above). Collectively, the drive train mounted upon the motor mount plate 109 of the rear portion of the body 102. The power source 111 may be screwed or bolted to the motor mount plate 109, or may be mounted by any other method that sufficiently secures the power source 111 to the motor mount plate 109. Such configuration allows for easy maintenance and/or replacement of the power source 111. In one embodiment, the belt 104 provides a motive connection in terms of a drive chain where sprocket hubs may therefore be provided on the crankshaft 110 and also on power receiving shaft 105. Alternatively, the belt 104 may be a grooved, flexible belt with a correspondingly appropriate set of hubs or any similar drive belt configuration that transfers power from the power source 111 to the clutch 301. Thus, any comparable connection between the crankshaft 110 and the clutch 301 may be used to achieve the same result without straying from the intended scope of the invention. It should also be understood that a chain-guard (not shown) may be provided to cover the belt 104 during use in order to shield this element for the sake of safety in a known manner.

It should be readily apparent that the power source 111 of the present invention advantageously allows the tractor engine (not shown) to be operated at low or idling engine RPM (revolutions per minute) while still allowing operation of the power source 111 at a high RPM. The independence of the power source 111 from the tractor engine thereby providing for the independently driven aspect of the present invention. Such operation allows snow removal powerfully enough to discharge snow a substantial distance and at the same time minimizes fuel consumption and wear and tear on the more expensive and valuable tractor engine (not shown). Additionally, this mode of operation serves to provide snow removal at an even greater rate and distance than expected from tractors of greatly varying horsepower, and provides a marked improvement over PTO powered units.

As mentioned, the universal mounting plate 106 may be attached to the rear portion of the snow blower body 102 by a configuration of supports 103, 107, and 108. As shown, the support 103 may join a center top portion of the universal mounting plate 106 to a top portion of the snow blower body 102. Likewise, supports 107 and 108 may join left central and right central portions of the universal mounting plate 106 to corresponding left central and right central portions of the snow blower body 102. Although such arrangement of supports is shown and described in one particular configuration, it should be readily apparent that any suitable configuration that provides the above mentioned compactness of the overall snow blower 100 and ensures that structural integrity of the plate 106 as attached to the snow blower body 102 is possible without straying from the intended scope of the present invention.

As previously mentioned, supports 107 serve as extended float skids mounted to the bottom portion of the body 102. In one embodiment, two such supports 107 may be employed with one being positioned at a left side and the other at a right side of the bottom portion of the body 102. The supports 107 advantageously provide balance to the body 102, allowing the body 102 to rest flat on the ground. This balance serves to further facilitate removable connection between the snow blower 100 and the tractor lift arms 401 by rendering the plate 106 a stable target for the tractor lift arms 401 during connection. Further, the length of supports 107 as they serve as extended float skids allows smoother tracking while the snow blower 100 is being operated along the ground than does the prior art.

As shown in FIGS. 3 and 4, the clutch 301 is employed to selectively isolate the motion between the power source 111 and the gear box of the snow blower internal components (not shown). In one embodiment as shown, this clutch 301 may be positioned on the power receiving shaft 105. However, it should be readily apparent that the clutch 301 may alternatively be positioned on the crankshaft 110 of the power source 111. In one embodiment, this clutch 301 may be an electromagnetic clutch. In another embodiment, the clutch 301 may be a centrifugal clutch. In yet another embodiment, the clutch 301 may be a mechanical clutch. However, any device capable of isolating the motion of the power source 111 from the gearbox may achieve the same result without straying from the intended scope of the invention. In operation, the clutch 301 may be constructed and arranged to slip at a specified torque so as to protect the snow blower housing units in case a foreign object, such as a rock, causes a jam. In this embodiment, the clutch 301 may operate to replace or supplement the use of shear pins (not shown) as is well known in the art. Further, employing a clutch 301 provides a substantial additional element of safety, allowing the operator to leave the power source 111 running while unsupervised, and reducing the danger of the moving snow blower housing units injuring someone or causing property damage.

In regard to FIG. 4, it can be seen that the universal mounting plate 106 facilitates connection to the tractor lift arms 401. Connection points 403 mounted to a forward end of each tractor lift arm 401 are constructed and arranged to selectively engage with the universal mounting plate 106. The selective engagement of the connection points 403 with the universal mounting plate 106 allows the snow blower 100 to be removably connected to the tractor lift arms 401. In one embodiment, the universal mounting plate 106 has a face that defines apertures 106*a* at a bottom portion. The face further defines a lip 106*b* that defines an acute angle with respect to the face. A connection point 403 mounted to each tractor lift arm 401 may be constructed and arranged to mate with the lip 106*b*, and engage with two apertures 106*a* via a latching system 403*a*. The latching system 403*a* operates by manually, mechanically, or hydraulically moving two retractable shafts so that they pass through the apertures 106*a*, thereby engaging with the apertures 106*a* and removably connecting the universal mounting plate 106 to the tractor lift arms 401. It should however be readily apparent that the details related to the connection of the universal mounting plate to the arms 401 may be accomplished in any known manner so long as a quick, yet secure, connection is made. Indeed, a corresponding mating plate (not shown) may be pre-attached to the tractor arms such that the universal mounting plate 106 connects to such corresponding mating plate. Such variations in plate connection are well within the intended scope of the present invention.

The universal mounting 106 plate may be of any size and shape that may facilitate a removable connection between the tractor lift arms 401 and the universal mounting plate 106. Preferably the universal mounting plate 106 may be a standard size, which may be approximately 49 inches wide and 18 inches tall. This sizing allows a standard tractor lift arm configuration to removably connect to the universal mounting plate 106. However, only the universal mounting plate 106 must be specifically configured to removably connect to the tractor lift arms 401. The entirety of the snow blower 100 could, for example, be of any particular size depending on snow removal needs, ease of use, and cost considerations.

As described earlier, the universal mounting plate 106 may be positioned adjacent to and in as close proximity to the body 102 as practical to minimize leverage and to allow the center of gravity to be as rearward on the tractor as possible, thereby maximizing maneuverability of a tractor utilizing the present invention. Further, because of the independently powered nature of the snow blower 100 contemplated herein, and the range of motion inherent to tractor arms in general, the snow blower 100 may be raised to any position along the motion of the tractor arms 401 with precision and control. As such, the present invention allows snow blower 100 operation at ground level, and also at an elevated level, to remove snow that may be, for example, piled high on a snow bank. Such precise control and greatly varying height positioning is typically not possible in the art of non-hydraulic (i.e., PTO-driven) front mounted snow blowers, which generally teach that only minimal adjustments in height may be made due to physical constraints related to requisite use of PTO extensions.

In operation, the snow blower 100 when removably connected to the tractor lift arms 401 may be raised or tilted to any height and direction achievable by the tractor lift arms 401 and the connection points 403. This is typically accomplished using any given tractor's known joystick controller in a manner similar to bucket movement. For example, the snow blower 100 may begin at ground level while angled upwards, and may be lifted up the slope of a large snow bank. In another example the snow blower 100 may be positioned parallel to the ground and lifted up to remove snow from a snow bank in steps. In yet another example the snow blower 100 may begin angled downwards and raised up, and may be lowered downwards against a large snow bank. These operational examples may be repeated and interchanged to provide optimal snow removal, capable of operating efficiently in a wide variety of snow removal situations.

In one embodiment, the snow blower 100 and its components may be configured to be controlled by an electronic system (not shown). In one embodiment, these electronic controls may include an electric starter for the power source 111, an electric throttle control, an electric control to engage and disengage the clutch 301, and an electric control (if an optional electrical motor is provided to the chute) for moving the chute 101 to control snow discharge direction. In one embodiment, these controls may be housed in a single control unit. Further, in another embodiment, these controls may operate with a minimal electricity requirement such that no battery upgrade is required on the existing tractor. The use of electronic controls in this embodiment greatly increases the ease of use by allowing complete control of the snow blower 100 through a connection of existing wires on the tractor to those on the snow blower 100. In one embodiment, these wires may be bundled together (i.e., via a wiring harness) and connected via a single connection point whereby an electrical connector may be permanently affixed to the tractor wiring system to enable quick connection and disconnection. This control structure, in combination with the maneuverability of the snow blower 100, allows far more efficient control of the snow blower 100 with much greater ease of set up than is known in the art.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. An independently powered snow blower for front mounting on a tractor, said blower comprising:

a body having a front, rear top and bottom portions, said body defining a snow capturing cavity at said front portion;

a plurality of internal components for snow movement being located within said body;

a motor mount plate positioned along said top portion of said body;

a power source mounted to said motor mount plate, said power source mechanically connected to said internal components via a drive train, said power source providing a motive power for operation of said internal components;

a universal mounting plate attached in close proximity to said rear portion of said body at a distance away from said body, said universal mounting plate being attached to said rear portion of said body by a plurality of structural supports, said universal mounting plate structurally forming a rear-most area of said blower, said rear-most area being positioned at an extreme opposite from said snow capturing cavity, said distance being minimized so as to provide a compact section sufficient to provide space for said drive train, and said universal mounting plate constructed and arranged to facilitate quick removable connection to a connection point of a plurality of tractor lift arms; and a clutch being constructed and arranged within said drive train to selectively isolate said power source from said internal components;

wherein at least two of said plurality of structural supports form a plurality of support skids attached to said bottom portion of said body, extending beyond said body, and connecting to said universal mounting plate;

wherein said snow blower is operable at extreme upper and extreme lower positions of said plurality of tractor lift arms, and any position within a range of motion achievable by said plurality of tractor lift arms.

2. The blower of claim 1, wherein said power source is a gasoline fueled engine.

3. The blower of claim 2, wherein said power source is mechanically connected to said internal components by a gearbox, and a drive belt is provided as part of said drive train for connection to said gearbox.

4. The blower of claim 3, wherein said clutch is an electromagnetic clutch.

5. The blower of claim 3, wherein said clutch is a centrifugal clutch.

6. The blower of claim 3, wherein said clutch is positioned on a power receiving shaft of said gearbox.

7. The blower of claim 3, wherein said clutch is positioned on a crankshaft of said power source.

8. The blower of claim 3, wherein said clutch is constructed and arranged to slip when under a predetermined torque.

9. The blower of claim 8, wherein said body further comprises a chute being rotatably connected to said body, said chute configured to further facilitate said snow movement.

10. The blower of claim 9, wherein said chute is manually rotatable.

11. The blower of claim 9, wherein said chute is electromechanically rotatable.

12. The blower of claim 11, wherein a throttle of said power source, a starter of said power source, and said chute are controlled electronically by a controller unit, said controller unit being remotely located from said snow blower.

13. The blower of claim 12, wherein said controller unit further controls operation of said clutch.

14. A kit for assembly of an independently powered front mounted tractor snow blower comprising:

a snow blower body having internal components capable of controlled movement of snow;

an independent power source capable of providing motive power for operation of said internal components of said body;

a motive connection mechanism capable of transferring power between said independent power source and said internal components;

a mounting mechanism capable of mounting said independent power source to said snow blower body;

a clutch capable of selectively isolating motive power provided by said independent power source from said internal components;

a universal mounting plate capable of facilitating quick removable connection between said snow blower body and a plurality of tractor lift arms; and an attachment mechanism capable of attaching said universal mounting plate to a rear portion of said snow blower body, said attachment mechanism being formed by a plurality of structural supports establishing said universal mounting plate in close proximity to a rear portion of said body at a distance away from said body, said universal mounting plate structurally forming a rear-most area of said blower, said rear-most area being positioned at an extreme opposite from a front portion of said blower, said distance being minimized so as to provide a compact section sufficient to provide space for said motive connection;

wherein at least two of said plurality of structural supports are capable of forming a plurality of support skids and are capable of attaching to a bottom portion of the body, extending beyond the body and connecting to said universal mounting plate.

15. The kit of claim 14, further including an installation manual for instructing a user on assembly of said independently powered front mounted tractor snow blower.

16. The kit of claim 15, wherein said independent power source is a gasoline powered engine.

17. The kit of claim 16, wherein said clutch is constructed and arranged to slip when under a predetermined torque.

18. The kit of claim 17, wherein said motive connection mechanism includes a belt, said belt capable of coupling a crankshaft of said gasoline powered engine to a power receiving shaft mechanically connected to said internal components.

* * * * *